US006634745B2

(12) United States Patent
Tanno

(10) Patent No.: US 6,634,745 B2
(45) Date of Patent: Oct. 21, 2003

(54) IMAGE FORMING APPARATUS

(75) Inventor: Koichi Tanno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/023,867

(22) Filed: Dec. 21, 2001

(65) Prior Publication Data

US 2002/0085078 A1 Jul. 4, 2002

(30) Foreign Application Priority Data

Dec. 28, 2000 (JP) ..... 2000-403449

(51) Int. Cl.[7] ..... B41J 2/01; B41J 13/02
(52) U.S. Cl. ..... 347/107; 347/104; 400/636
(58) Field of Search ..... 347/107, 101, 347/104, 105; 291/193, 276; 400/627, 636, 641, 642, 43, 48

(56) References Cited

U.S. PATENT DOCUMENTS 5,567,069 A * 10/1996 Suzuki et al. ..... 400/636
6,027,212 A 2/2000 Tanno et al. ..... 347/108
6,092,892 A 7/2000 Taniguro et al. ..... 347/104
6,260,950 B1 7/2001 Tanno et al. ..... 347/49
6,293,670 B1 9/2001 Taniguro et al. ..... 347/104
6,416,176 B1 * 7/2002 Yasui et al. ..... 347/104

* cited by examiner

*Primary Examiner*—John Barlow
*Assistant Examiner*—An H. Do
(74) *Attorney, Agent, or Firm*—Fitzpatrick, Cella, Harper & Scinto

(57) ABSTRACT

An image forming apparatus forms an image on a recording medium by discharging ink from a recording head. The apparatus has ejection rollers for causing the recording medium to move at a position downstream of the recording head as viewed in the direction of movement of the recording medium. The apparatus also has idle rollers driven by the ejection rollers. The apparatus further has recording medium supporting members disposed downstream of the ejection rollers and arranged to guide the recording medium. The recording medium supporting members and the idle rollers are located on common straight lines which extend in the direction of movement of the recording medium. This arrangement obviates undesirable lifting of the recording medium and prevents rubbing of the recording medium on the recording head.

10 Claims, 11 Drawing Sheets

IMAGE FORMING APPARATUS

BACKGROUND OF THE INVENTION

1. Field of the Invention

The present invention relates to an image forming apparatus for forming an image on a recording medium.

2. Description of the Related Art

In general, an ink jet recording apparatus as one type of image forming apparatus has a recording head which discharges ink droplets to form and record on a recording medium characters, images and so forth (collectively referred to as an "image" hereinafter). The term "recording medium" is used in this specification to generally encompass web or sheet-type media which have small thicknesses and on which images are formable by an ink. Thus, the recording medium may be a sheet of plain paper, a sheet of resinous recording medium as a substitute for the plain paper, a postcard, an envelope, a label, and so on. In this specification, the term "sheets" is used to encompass all such possible recording media.

Ink jet recording apparatuses offer various advantages such as ease of miniaturization of recording heads, capability of recording fine images at high speed, low running cost, reduced noise level due to non-impact nature, and ease of recording color images with multiple color inks.

In general, an ink jet recording apparatus is configured such that a recording medium sheet is fed from a sheet feed section onto a platen which opposes a recording head and which supports the recording medium sheet at the reverse side thereof while the recording head records an image on the obverse side of the recording medium sheet. The recording medium sheet carrying the image recorded thereon is ejected from the apparatus through an ejecting section which is disposed at the downstream end as viewed in the direction of convey of the recording medium sheet.

To be more specific, reference is made to FIG. 8 which shows an overall arrangement of a known ink jet recording apparatus generally denoted by 1, FIG. 9 which is a sectional view of the ink jet recording apparatus 1, and FIG. 10 which shows a portion of the apparatus 1 including a recording medium sheet ejecting section denoted by 4. In FIG. 10, components such as a conveyor roller 36, a pinch roller 37, spurs 42, an ejecting roller 41, as well as a sheet P, are schematically shown in a perspective view. Since FIG. 10 is a schematic illustration, the dimensional relationships between the components in this Figure do not exactly conform with those in FIG. 9. Reference is made also to FIG. 11 which is a sectional view taken along the line C—C of FIG. 10.

Referring to FIGS. 8 to 11, a stack of recording medium sheets P is placed on a sheet feed section 2, and the recording medium sheets are fed by a sheet feed roller 22 in one-by-one fashion starting from the topmost sheet toward a position where a recording head 7 is located. The sheet P is nipped between the pinch roller 37 and the conveyor roller 36 which is driven by power derived from a drive source which is not shown, and is conveyed to a recording start position on a platen 34.

The recording head 7 is detachably secured to a carriage 50 which is carried by a guide shaft 81 for reciprocal movement along the guide shaft 81 in directions which cross the direction of convey of the sheet P. Thus, the recording head 7 performs recording of images on the sheet P which is being conveyed, while moving in directions that cross the direction of movement of the sheet P.

The ejection roller 41 is driven by the conveyor roller 36 through a transmission roller 40. The ejection roller 41 has a plurality of roller elements 41*a* which are made of an elastomer or a rubber and which are arranged in the direction of width of the sheet P so as to convey the sheet P.

There are a plurality of spurs 42 each of which is held in pressure contact with the associated roller element 41*a*. Each spur 42 rotates in contact with the recording medium sheet which carries an image formed thereon. In order to prevent transfer of the ink, therefore, the spur 42 has a plurality of radial projections with pointed ends.

The recording sheet medium P is pinched between and conveyed by the conveyor roller 36 and the pinch roller 37, until its leading end is caught between the ejection roller 41 and the spur 42. The sheet P, after its trailing end has cleared the nip between the conveyor roller 36 and the pinch roller 37, is conveyed by the ejection roller 41 and the spur 42. The sheet P is then ejected onto and received by a sheet ejection tray 100.

The upper surface of the platen 34 has a plurality of ribs 34*a* which project therefrom and which extend in the direction of movement of the sheet P. The ribs are arranged at intervals in a direction which crosses the direction of movement of the sheet P. Each rib 34*a* is aligned with one of the spurs 42 which is disposed downstream of the rib 34*a*, as viewed in the direction of movement of the sheet P. In other words, each rib 34 and the associated spur 42 are disposed on a common straight line which extends in the direction of movement of the sheet P. With this arrangement, crests of waviness of the recording medium sheet, which occur when the sheet P is wetted by the ink, are flattened by the effect of the spurs 42. This waviness will be referred to as "cockling", hereinafter. In addition, the sheet P is caused to cockle downward at portions thereof not supported by the ribs, so that floating of the sheet P is minimized while the sheet passes through the recording section.

The cockling of the sheet P occurs at regular portions thereof due to the regular arrangement of the ribs 34*a*. This means that the distance between the sheet P and the recording head 7 regularly varies along the breadth of the sheet P, which if not corrected may degrade the quality of the recorded image. In order to obviate this problem, the discharge of the ink from the recording head 7 is performed so as to compensate for any influence caused by the presence of the ribs the height of which is known, whereby any degradation of the image quality which otherwise may be caused by the presence of the ribs is effectively corrected.

The problem of cockling is serious particularly when an image is "painted" with a dye color ink which is permeable to the material of the recording medium sheet. In order that images of high quality are stably formed with this type of ink, it is necessary to strictly maintain a constant gap between the sheet P and the recording head, thereby minimizing undesirable effects of cockling.

Image recording apparatuses also have recently been proposed which use pigment-type black ink in order to increase the density of black color of images. A considerably long time is required for this type of ink to be dried and fixed after being deposited on a recording medium sheet. A problem is therefore encountered with the use of this type of ink. It is assumed here that two recording medium sheets, a first sheet and a second sheet, are successively ejected. In such a case, the leading end of the second sheet rubs the ink which is still wet on the first sheet which has been ejected. Consequently, the image on the first recording medium sheet is fouled. The phenomenon of fouling the image on the leading recording medium sheet is generally referred to as "smear".

The image forming apparatus shown in FIG. 9 has sheet supporting members 47 which are provided in the sheet ejection section 4 and which serve as means for preventing smearing. The sheet supporting members 47 serve to support the sheet P after recording so as to prolong the time required for the sheet P to land on a sheet ejection tray 200 after the discharged ink is deposited on the sheet P. A subsequent sheet P, i.e., the second sheet, is then ejected to fall onto the recording medium sheet when the ink on the preceding recording sheet medium P, i.e., the first sheet, has been dried, thus preventing smearing of the image on the first sheet.

Hitherto, the sheet supporting members 47 are arranged in the direction of breadth of the sheet P, i.e., in the direction which crosses the direction of movement of the sheet P. The supporting projections 47 are projectable in the downstream direction from the platen 34 and retractable into the platen 34.

The sheet supporting members 47, when projected in the downstream direction, guide the sheet P to a level higher than the horizontal plane of the sheet P in the recording section, so as to support the sheet P by making use of stiffness inherent to the sheet P, whereby the time required for the sheet P to land on the sheet ejection tray 200 after the image formation is prolonged.

In the known arrangement, the sheet supporting members 47 are positioned to intervene between the adjacent spurs 42 such that the projections 47 and the spur 42 are disposed alternately in the breadthwise direction of the sheet. The sheet supporting members thus arranged tend to lift the portions of the sheet P that have cockled to be convex downward in the recording section, thus canceling the cockle of the sheet P. Rather, these sheet supporting members 47 cause the sheet P to cockle and project upward at portions between adjacent spurs 42, which in turn causes these portions of the sheet P to float significantly also in the recording section. This poses a risk for the sheet P to undesirably contact the recording head 7 or the carriage 50, resulting in fouling of the recording surface due to rubbing and, in the worst case, damaging of the recording head 7 particularly at the ink jet surface thereof.

The sheet supporting members 47 are arranged to project from the platen 34 when the leading end of the sheet P which is undergoing the image forming process has cleared the spurs 42. Therefore, the free ends of the sheet supporting members 47 strongly impinge against the sheet P, which hampers the image forming operation to impair the quality of the image.

Another problem is that the use of discrete sheet supporting members 47 arranged in the direction of breadth of the sheet P undesirably raises the production cost of the image forming apparatus.

SUMMARY OF THE INVENTION

Accordingly, it is an object of the present invention to provide an image forming apparatus which obviates problems such as impairment of image quality due to smear, while suppressing floating of the recording medium sheet and avoiding rubbing of the recording medium sheet against the recording head.

To this end, according to the present invention, there is provided an image forming apparatus for forming an image on a recording medium by discharging an ink from a recording head, comprising: at least one ejection roller for causing the recording medium to move at a position downstream of the recording head as viewed in the direction of movement of the recording medium; at least one idle roller driven by the ejection roller; and at least one recording medium supporting member disposed downstream of the ejection roller as viewed in the direction of movement of the recording medium and arranged to guide the recording medium, the recording medium supporting member and the idle roller being located on a common straight line which extends in the direction of movement of the recording medium.

Further objects, features and advantages of the present invention will become apparent from the following description of the preferred embodiments with reference to the attached drawings.

DESCRIPTION OF THE PREFERRED EMBODIMENTS

Embodiments of the present invention will now be described with reference to the drawings.

[First Embodiment]

Figure 1:
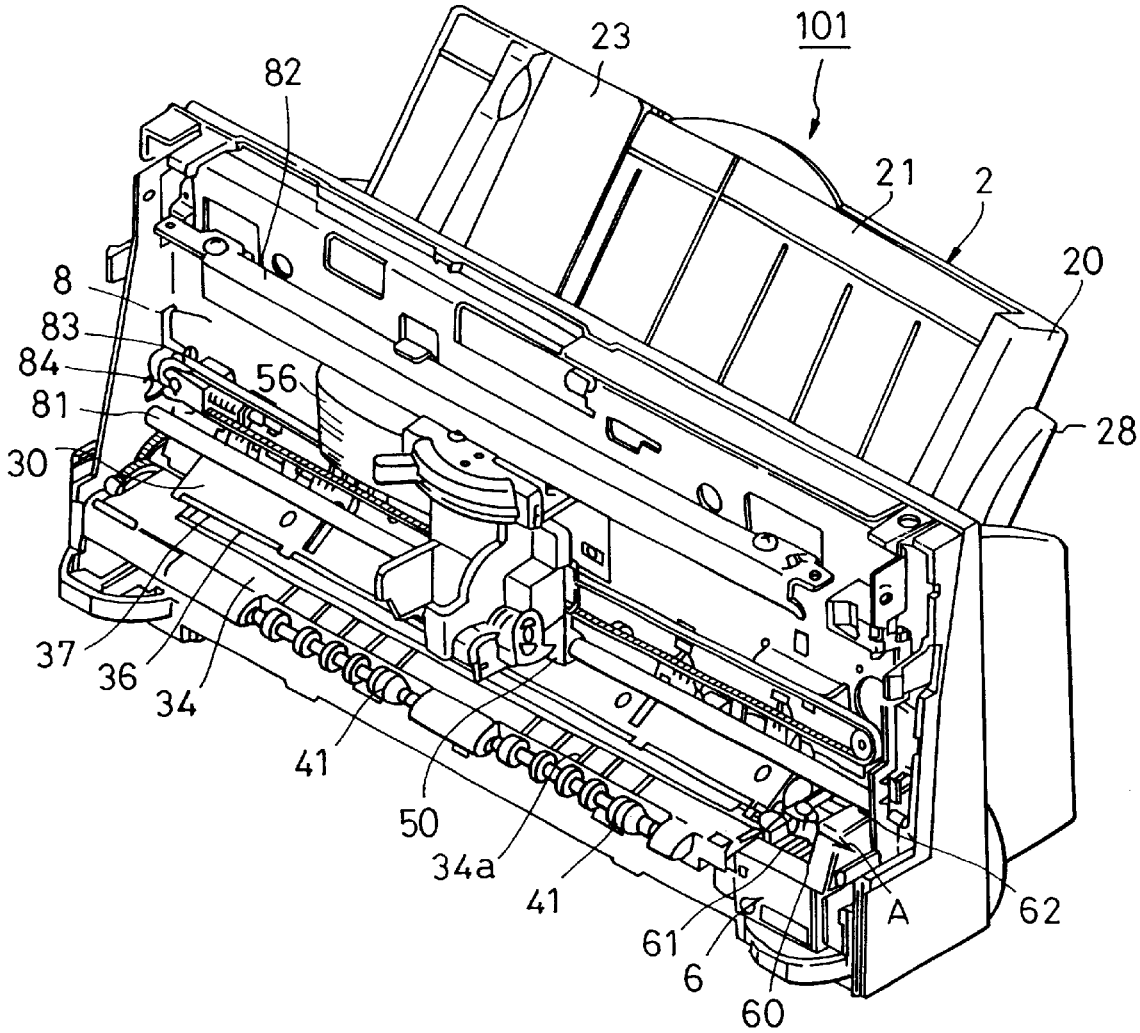
FIG. 1 is a perspective view of an ink jet recording apparatus embodying the present invention, showing an appearance of the apparatus.
Figure 2:
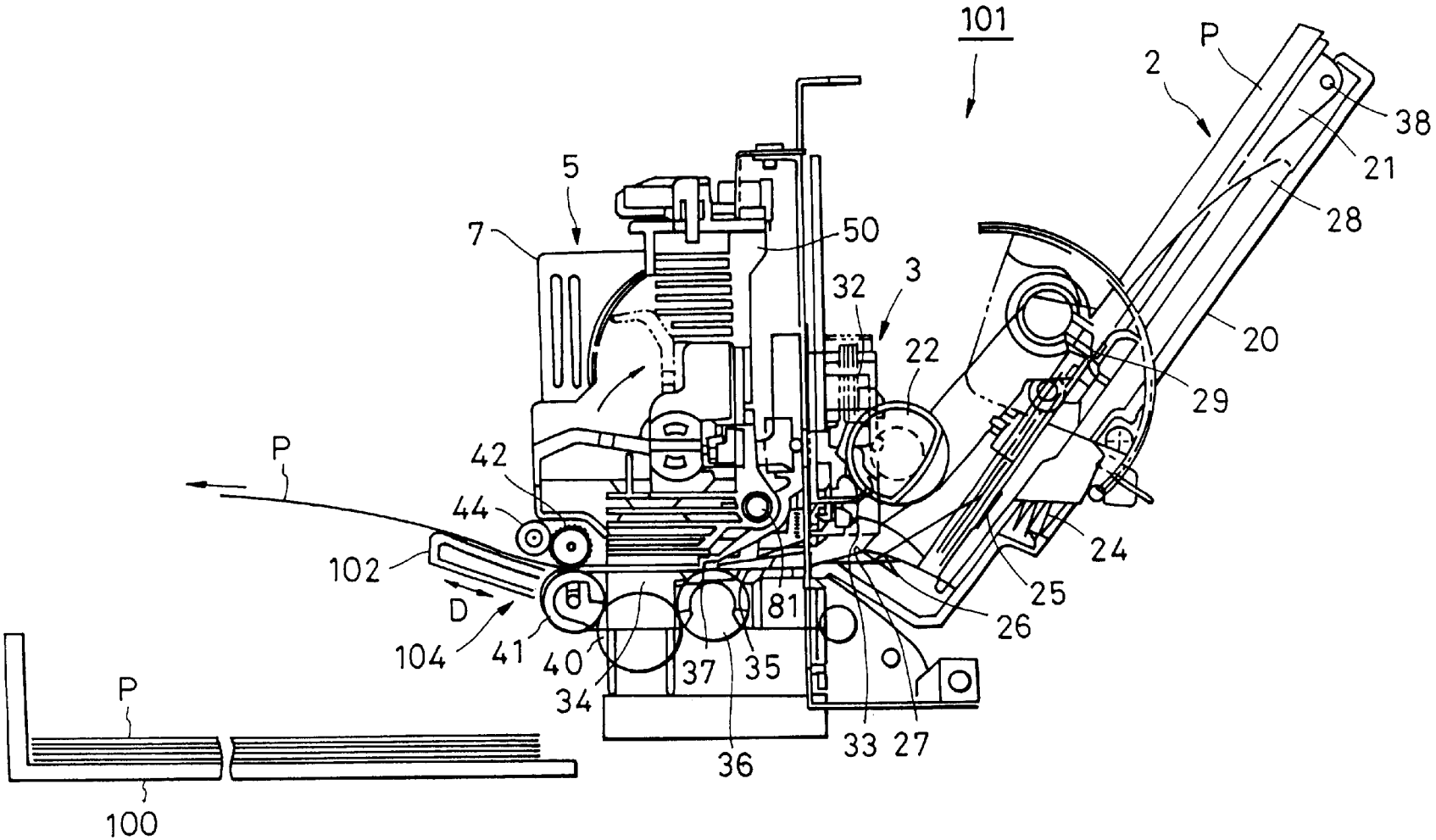
FIG. 2 is a sectional view of the ink jet recording apparatus shown in FIG. 1, taken along a plane which extends in the direction of convey of a recording medium sheet.

Referring to FIGS. 1 and 2, an ink jet recording apparatus as an embodiment of the image forming apparatus of the present invention is generally denoted by 101, and is equipped with an automatic sheet feeding device which automatically feeds recording medium sheets (simply referred to as "sheets", hereinafter). The ink jet recording apparatus 101 has a sheet feeder section 2, a sheet conveyor section 3, a sheet ejection section 104, a carriage section 5, a cleaning section 6, and so forth. The configuration or arrangement of each of these sections will be described below, by employing the same reference numerals as those used in the foregoing description of the related art to denote the same or corresponding components or parts.

(Sheet Feeder Section)

The sheet feeder section 2 has a base 20 to which are secured a pressing plate 21 for carrying a stack of recording medium sheets P and a feeder roller 22 for feeding the sheets P. A movable side guide 23 for regulating the positions of the sheets P in the breadthwise direction is slidably secured to the pressing plate 21. The pressing plate 21 is rotatable about an axis of a pressing plate shaft 38 attached to the base 20. The pressing plate 21 is urged against the feeder roller 22 by means of a pressing plate spring 24.

Figure 4:
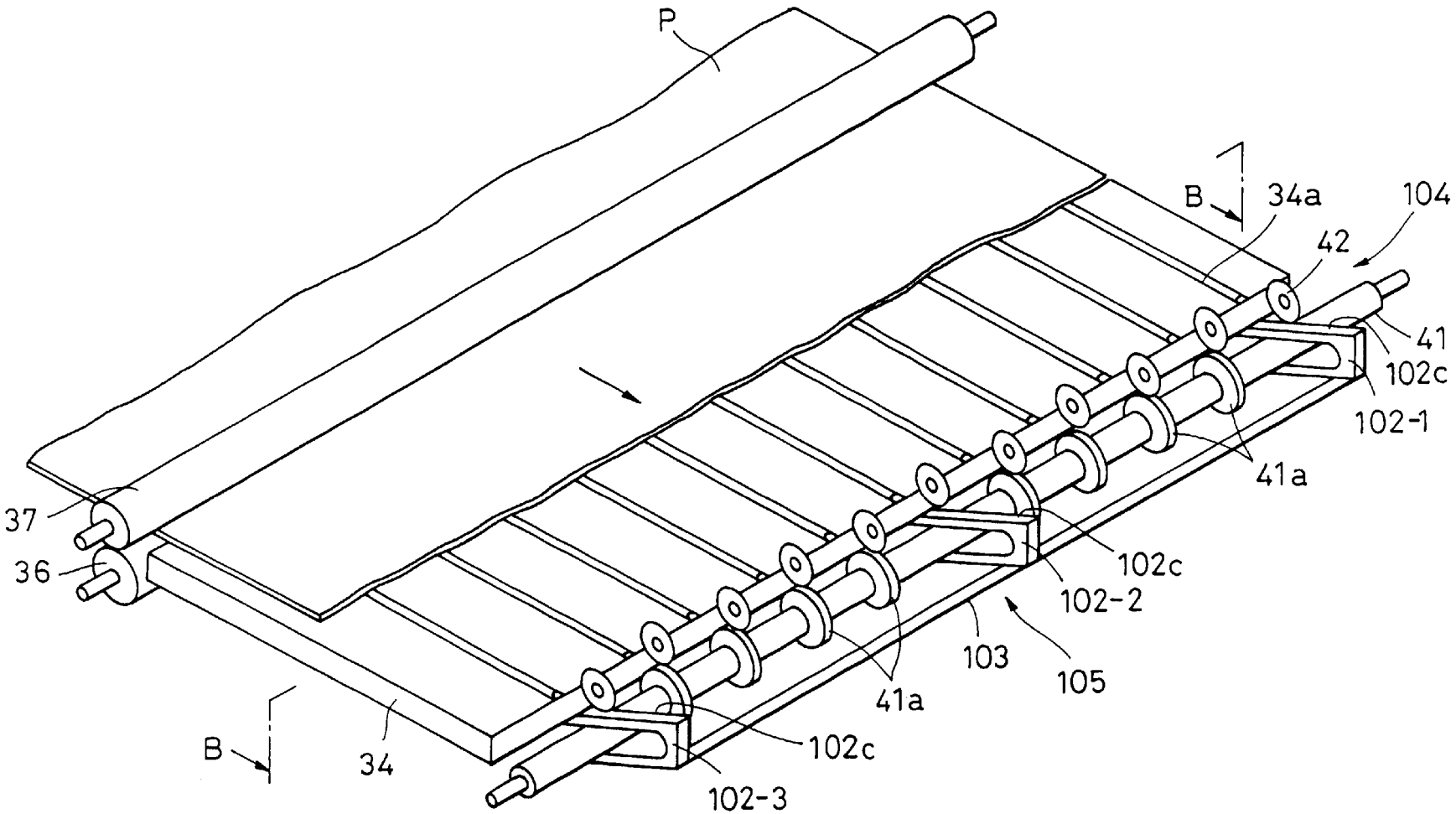
FIG. 4 is a schematic illustration of positional relationships between components such as a conveyor roller, a pinch roller, an ejection roller shaft, spurs, and recording medium sheet supporting members, in relation to a recording medium sheet.

FIG. 4 is a schematic illustration of positional relationships between components such as a conveyor roller, a pinch roller, an ejection roller shaft, spurs, and recording medium sheet supporting members, in relation to a recording medium sheet.

Figure 5:
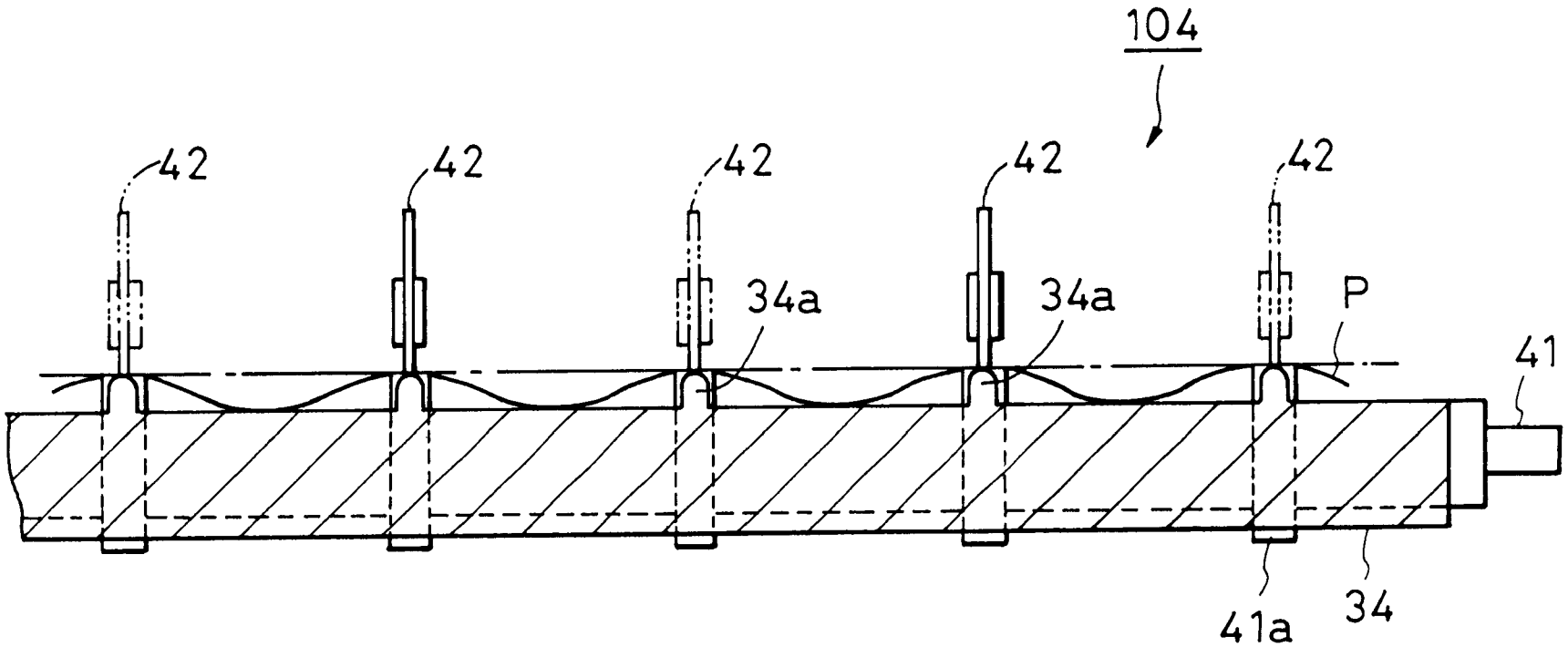
FIG. 5 is a sectional view taken along the line B—B of FIG. 4.

FIG. 5 is a sectional view taken along the line B—B of FIG. 4.

A separator pad 25 for preventing duplicate feed of the sheets P is provided on a portion of the pressing plate 21 at a position facing the feeder roller 22. The separator pad 25 is made of a material having a large friction coefficient, such as artificial leather. Attached also to the base 20 is a separator claw 26 which covers a corner of the stack of the sheets P to separate the sheets P one by one. The base 20 has an embankment 27 which is integral with the base 20 and which serves as a separator for separating a recording medium sheet which is too thick to be separated by the separator claw 26.

The sheet feeder section 2 also has a change-over lever 28 that can be switched between a normal sheet position where it allows the separator claw 26 to operate and a thick sheet position where it disables the separator claw 26. The sheet feeder section 2 further has a release cam 29 which serves to release the pressing plate 21 from the feeder roller 22.

The operation of the sheet feeder section 2 having the described structure works as follows. In the standby state of the sheet feeder section 2, the pressing plate 21 has been lowered to predetermined position by the effect of the release cam 29 acting against the urging force exerted by the pressing plate spring 24. Thus, the pressing plate 21 is kept away from the feeder roller 22. When driving power of the conveyor roller 36 is transmitted to the feeder roller 22 and the release cam 29 via, for example, transmission gears, the release cam 29 releases the pressing plate 21 so as to allow the pressing plate 21 to be raised by the force of the pressing plate spring 24, thereby pressing the stack of the recording medium sheets P against the feeder roller 22. The topmost sheet P of the stack is therefore fed by the feeder roller 22 to the conveyor section 3 while being separated by the separator claw 26.

The feeder roller 22 and the release cam 29 continue to rotate until the recording medium sheets P is received by the conveyor section 3. Thereafter, the stack of the recording medium sheets P is separated from the feeder roller 22, whereby the feeder section 2 is set in the standby state in which the transmission of the driving power from the conveyor roller 36 is suspended.

(Conveyor Section)

The conveyor section 3 has a conveyor roller 36 for conveying the recording medium sheet P, a pinch roller 37 for cooperation with the conveyor roller 36, a PE sensor 37, and so on. The pinch roller 37 is pressed onto the conveyor roller 36 so as to be driven by friction through a recording medium sheet P nipped therebetween. The pinch roller 37 is rotatably supported by a pinch roller guide 30 which is urged by pinch roller springs 31 into pressure contact with the conveyor roller 36 across the recording medium sheet P, thereby causing a traction force to be produced to convey the sheet P. The recording medium sheet P fed from the sheet feeder section 2 is received by an inlet portion of the conveyor section 3.

The inlet portion has an upper guide member 33 for guiding the recording medium sheet P and a platen 34. The platen 34 also serves as a sheet guide member. The upper guide member 33 is provided with a PE sensor lever 35, which detects arrival of the leading and trailing ends of the recording medium sheet P so as to inform the PE sensor 32 of the arrival of each end of the sheet P.

In operation, the recording medium sheet P fed to the conveyor section 3 is moved into the nip between the conveyor roller 36 and the pinch roller 37, while being guided by the platen 34, upper guide member 33 and the pinch roller guide 30. As a result, the leading end of the sheet P is detected by the PE sensor lever 35, whereby the position of recording on the recording medium sheet P is determined. The sheet P is continuously fed by the cooperation between the conveyor roller 36 which is driven by power derived from an LF motor (not shown) and the pinch roller 37 which is driven by friction.

The ink jet recording apparatus 1 has a recording head 7 serving as image forming means. The recording head 7 is detachably carried by a carriage 50 and is provided with an ink tank detachably mounted thereon. The recording head 7 is equipped with a heater for heating the ink to cause film boiling of the ink. Ink droplets are discharged from nozzles 70 on the recording head 7 due to a change in the pressure of the ink caused by growth or contraction of a bubble in the ink due to the film boiling, whereby an image is formed on the recording medium sheet P.

(Carriage Section)

The carriage section 5 has the above-mentioned carriage 50 which detachably carries the recording head 7. The carriage 50 is supported both by a guide shaft 81 and a guide rail 82. The carriage 50 is reciprocally movable along the guide shaft 81 in directions which cross the direction of movement of the recording medium sheet P. The guide rail 82 supports a rear end portion of the carriage 50 so as to maintain a predetermined gap between the recording head 7 and the recording medium sheet P. Both the guide shaft 81 and the guide rail 82 are secured to the chassis 8 of the apparatus. A timing belt 83 is connected to the carriage 50. The timing belt 83 is driven by a carriage motor (not shown) secured to the chassis 8, whereby the carriage 50 is reciprocally moved. The timing belt 83 is stretched and supported by an idle pulley 84. The carriage 50 also has a flexible circuit board 56 through which electrical signals are transmitted to the recording head 7 from an electrical circuit board which is not shown.

In operation, the recording medium sheet P is advanced by the roller pair 36, 37 to a predetermined line position (position located in the direction of movement of the sheet P), while the carriage 50 is driven by the carriage motor to bring the recording head 7 to a designated columnar position (position located in the direction perpendicular to the direction of movement of the sheet P), thereby locating the recording head 7 at a position where an image is to be formed. Then, the recording head 7 is activated in accordance with electrical signals transmitted from the electrical circuit board 9, so as to discharge ink droplets, thereby forming an image.

The arrangement is such that, when an operation key (not shown) is pressed, the carriage 50 is automatically moved to a predetermined position, where mounting and demounting of the recording head on and from the carriage 50, as well as mounting and demounting of the ink tank on and from the recording head 7, are possible.

(Cleaning Section)

Referring back to FIG. 1, the cleaning section 6 has a pump 60 for cleaning the recording head 7, a cap 61 for covering the recording head 7 to prevent drying, a drive switching arm 62 which is switchable between a position where it permits the power from the conveyor roller 36 to be transmitted to the sheet feeder section 2 and a position where it permits the driving power to be transmitted to the pump 60, and so forth. Except for the operation for feeding the recording medium sheet and the operation for cleaning the recording head 7, the drive switching arm 62 keeps a planetary gear (not shown) revolvable about the axis of the conveyor roller 36 at a predetermined position, so that the driving power is transmitted neither to the sheet feeder section 2 nor to the pump 60.

A movement of the carriage 50 causes the drive switching arm 62 to move in the direction of an arrow "A", and the planetary gear is freed to revolve back and forth in accordance with the direction of rotation of the conveyor roller 36. When the conveyor roller 36 rotates forward, the driving power is transmitted to the sheet feeder section 2, whereas, when the same rotates backward, the driving power is transmitted to the pump 60.

(Sheet Ejection Section)

The construction of the sheet ejection section will be briefly described. A transmission roller 40 is held in contact with both a conveyor roller 36 and an ejection roller shaft 41. The power of the conveyor roller 36 is therefore transmitted to the ejection roller shaft 41 via the transmission roller 40. Spurs 42 are arranged to be contactable with a sheet ejection roller 41*a* carried by the ejection roller shaft 41, so as to be driven by the sheet ejection roller 41*a* by friction. Thus, the spurs 42 also may be referred to as "idle rollers". A freely rotatable cleaning roller 44 is held in contact with the spurs 42. The spurs are arranged to rotate on the recording surface of the recording medium sheet P carrying an image. In order to prevent undesirable transfer of the ink forming the image, therefore, a plurality of radial projections 42*a* having pointed ends are formed on the peripheral surface of each spur 42.

In operation, the recording medium sheet P, which carries an image formed by the carriage section 5, is conveyed by being nipped between the sheet ejection roller 41*a* and the spurs 42, so as to be ejected onto a sheet ejection tray 100 shown in FIG. 1.

Figure 3:
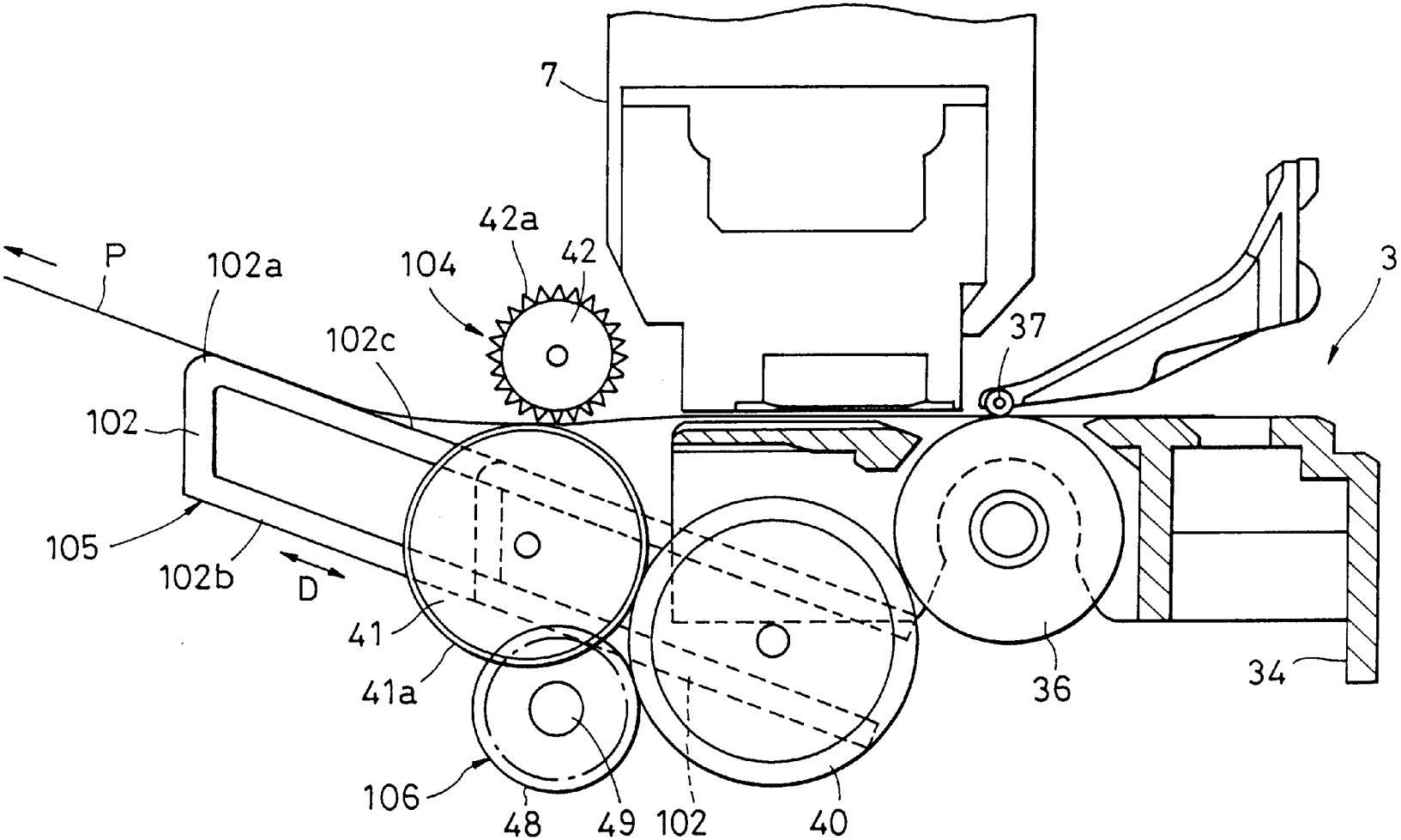
FIG. 3 is an enlarged sectional view of the apparatus of FIG. 2, showing particularly a sheet conveying section and a sheet ejection section.

A detailed description will now be given of the operations of the sheet conveyor section 3 and the sheet ejection section 104, with specific reference to FIGS. 2 to 5. As explained before, FIG. 2 is a sectional view of the ink jet recording apparatus 101 taken along a plane which extends in the direction of convey of the recording medium sheet. FIG. 3 is a sectional view taken along the same plane as FIG. 2, showing particularly the sheet conveyor section 3 and the sheet ejection section 104 in a greater scale. FIG. 4 is a schematic illustration of positional relationships between components such as the conveyor roller 36, the pinch roller 37, the ejection roller shaft 41, the spurs 42, and recording medium sheet supporting members 102, in relation to a recording medium sheet. FIG. 4 is a schematic illustration so that the dimensional relationship between these components does not exactly correspond to that shown in FIG. 2. FIG. 5 is a sectional view taken along the line B—B of FIG. 4.

Referring to FIG. 4, ribs 34*a* are formed on the upper surface of the platen 34, so as to extend in the direction of convey of the recording medium sheet P. These ribs 34*a* are arranged at a regular interval in the direction of breadth of the recording medium sheet. As will be described later, a plurality of sheet supporting members 102 are provided, and each sheet supporting member is arranged in alignment with adjacent rib 34 and spur 42, i.e., disposed on a single straight line which extends in the direction of movement of the recording medium sheet and on which the rib 34 and the spur 42 are disposed. Therefore, when the recording sheet medium P is supported by the sheet supporting members 102, downward convexities of the cockle of the sheet, that were formed during the image forming process, are efficiently and conveniently accommodated by the spaces preserved between adjacent ribs 34*a*.

A detailed description will now be given of the sheet supporting members 102. By way of examples, the illustrated embodiment employs three sheet supporting members 102-1, 102-2 and 102-3 which are disposed adjacent to the ejection roller shaft 41 and spaced in the direction of breadth of the recording medium sheet P. These three sheet support members 102 are connected together by a connecting member 103 to form an integral sheet supporting structure 105.

The sheet supporting structure 105 is supported by the platen 34 by means of a suitable supporting structure which is not shown. The sheet supporting structure 105 having the sheet supporting members 102 is obliquely movable between a retracted position shown by broken lines in FIG. 3 and a supporting position shown by solid lines in the same Figure. It is to be understood, however, that the sheet supporting structure need not be an integral or unitary structure but may be composed of a plurality of discrete sheet supporting members which are individually supported by the platen 34. Image forming apparatuses using such discrete sheet supporting members also fall within the scope of the present invention.

The sheet supporting members 102 in their projected supporting positions serve to guide and support the recording medium sheet P to and at a level above the level of the horizontal plane of the sheet P in the recording section. The conveyor roller 36 and the pinch roller 37, as well as the ejection roller shaft 41 and the spurs 42, are arranged such that an optimum gap is strictly maintained between the recording medium sheet P and the recording head 7 while the sheet P passes through the recording section.

After the leading end of the recording medium sheet P has cleared the spurs 42, the leading portion of the sheet P is guided by the slanted upper surface 102*c* of the sheet support members 102 and is supported by the highest, downstream ends 102*a* of the sheet supporting members 102. Recording medium sheet P of so-called A-4 size is supported by two sheet supporting members 102-1 and 102-2, whereas an A-3 size medium sheet is supported by all the three supporting members 102-1 to 102-3. The recording medium sheet has been stiffened such that the sheet is flexed downward by the gravity at the longitudinal center portion thereof when almost half of the sheet has been moved beyond the downstream ends of the sheet supporting members, regardless of the size of the sheet.

In order to give such a level of stiffness to an A-3 size recording medium sheet, the downstream end 102*a* of the central sheet supporting member 102-2 is disposed at a level which is slightly below the level of the downstream ends 102*a* of other two sheet supporting members 102-1 and 102-2. Such a difference in the level of the downstream ends of the sheet supporting members, however, are not essential and the invention does not exclude an arrangement in which the downstream ends of all the sheet supporting members are positioned at an equal level.

A description will now be given of the operation of the sheet supporting members 102-1 to 102-3.

Referring to FIG. 3, a rack 102*b* is formed on the lower side of each sheet supporting member 102 and is held in meshing engagement with a drive gear 48. The drive gears 48 are fixedly carried by a common drive shaft 49 which is driven by a drive motor (not shown). The drive motor operates under the control of a control circuit (not shown) in accordance with the detecting operations performed by the PE sensor 32. The rack 102*b,* the drive gear 48, the drive shaft 49, the drive motor, the control circuit, the PE sensor and other associated components in cooperation form an operating section or means which is generally denoted by 106. The illustrated embodiment may be modified that the rack 102*b* is provided on only one of the three sheet supporting members for engagement with one drive gear, because in this embodiment a unitary sheet supporting structure 105 is formed by connecting together the three sheet supporting members 102-1 to 102-3.

In operation, the drive motor is actuated to drive the drive gears via the drive shaft 49, so that the three sheet supporting members 102-1 to 102-3 having racks meshing with the drive gears 48 are linearly and reciprocally moved back and forth in the direction of an arrow "D" in FIG. 3. Thus, the sheet supporting members 102-1 to 102-3 are reciprocally moved between the supporting position shown by solid lines in FIG. 3 and the retracted position shown by broken lines in the same Figure.

In the illustrated embodiment, the timing of movement of the sheet supporting members is so controlled that the sheet supporting members 102 are projected to the supporting position simultaneously with the sheet feeding operation performed by the sheet feeding section 2 and moved back to the retracted position concurrently with the completion of the operation for ejecting the sheet after the image formation. This, however, is not exclusive and the arrangement may also be such that the sheet supporting members are projected after the recording medium sheet P has been fed from the sheet feeder section 2 to the recording section. Thus, the sheet supporting members 102 may be moved to the supporting position at a suitable timing before the recording operation of the recording head is commenced.

The control of the timing for projecting and retracting the sheet supporting members is performed by the control circuit, in accordance with the factors such as the size of the recording medium sheet, position of the recording area on the sheet, and so forth.

The stroke or length over which the sheet supporting members 102 project is variable by changing the length of time over which the drive motor of the operating section 106 is activated. It is to be noted, however, that the operating section 106 for automatically projecting and retracting the sheet supporting members may be omitted. Thus, the arrangement may be such that the sheet supporting members are pulled out from the platen to the supporting position and pushed back into the retracted position by manual force. The arrangement also may be such that the sheet supporting members 102 are fixed so as to project in the downstream direction beyond the position of the spurs. In such a case, the sheet supporting members may be formed integrally with the platen 34.

As will be understood from the foregoing description, in this embodiment of the image forming apparatus, each sheet supporting member 102 is positioned in alignment with the associated rib 34*a* on the platen 34 and the associated spur 42, such that the rib 34*a,* the spur 42 and the sheet supporting member 102 are positioned on a common straight line which extends in the direction of convey of the recording medium sheet. Therefore, regular cockles of the recording medium sheet produced by the presence of the ribs 34*a* on the platen 34 are maintained without being significantly canceled by the sheet supporting members 102.

The image forming apparatus may use an exclusive thick recording medium sheet which is almost free from cockling. Such a thick recording medium sheet, if supported by the sheet supporting members 102 projected from the platen, may undesirably float due to large rigidity of the sheet. Such floating of the sheet may adversely affect the image forming operation. When such a thick recording medium sheet is used, therefore, the sheet supporting members 102 are held at the retracted position so as not to support the sheet which is being ejected from the recording section.

The illustrated first embodiment of the present invention therefore ensures high quality of the product image, regardless of the thickness of the recording medium sheet.

[Second Embodiment]

Figure 6:
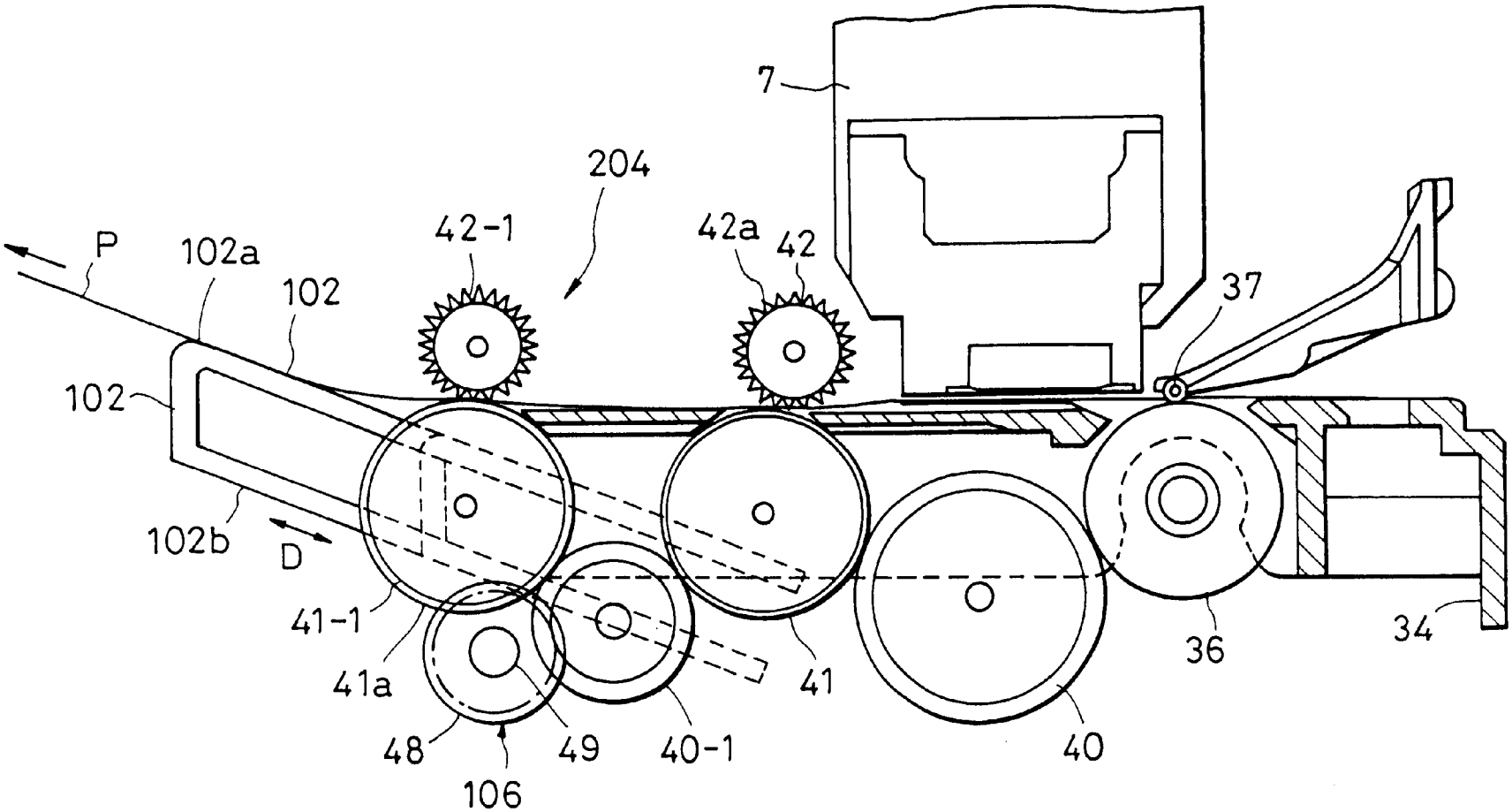
FIG. 6 is a sectional view of an ink jet recording apparatus as a second embodiment of the present invention, taken along a plane which extends in the direction of convey of a recording sheet medium.

Referring to FIG. 6, an ink jet recording apparatus as a second embodiment of the present invention has a sheet ejection section 204 which includes two stages of the combination of the sheet ejection roller shaft and the spurs. More specifically, the sheet ejection section 204 includes a first combination constituted by a first ejection roller shaft 41 and first spurs 42 arranged in the same manner as those in the first embodiment, and further includes a second combination constituted by a second ejection roller shaft 41-1 and second spurs 42-1 which are held in pressure contact with the second ejection roller shaft 41-1 so as to be frictionally driven by this shaft 41-1. As illustrated, the second combination of the ejection roller shaft and spurs is disposed downstream of the first combination, as viewed in the direction of movement of the recording medium sheet.

At the same time, the second ejection roller shaft 41-1 is disposed at the same level as the first ejection roller shaft 41, and the second spurs 42-1 are disposed at the same level as the first spurs 42. The driving power of the first ejection roller shaft 41 is transmitted to the second ejection roller shaft 41-1. The nip between the second ejection roller shaft 41-1 and the second spurs 42-1 is positioned at the same level as the nip between the first ejection roller shaft 41 and the first spurs 42. As a result, an ample flush plane is formed at the same level as the recording plane, over a long path of travel of the recording sheet medium, from the nip between the conveyor roller 36 and the pinch roller 37 to the nip between the second ejection roller shaft 41-1 and the second spurs 42-1. Thus, the second embodiment offers a further improvement in the recording precision over the first embodiment.

The second embodiment has sheet supporting members 102 which are aligned with the second spurs 42-1: namely, each second supporting member 102 and the associated second spur 42-1 are disposed on a common straight line which extends in the direction of movement of the recording medium sheet.

The operation of the sheet ejecting section 204 is substantially the same as the operation performed by the sheet ejection section 104 of the first embodiment. In the second embodiment, however, the timing of operation of the sheet ejection section 204 may be such that the sheet supporting members 102 project from the platen 34 after the leading end of the recording sheet medium P has cleared the second spurs 42-1.

[Third Embodiment]

Figure 7:
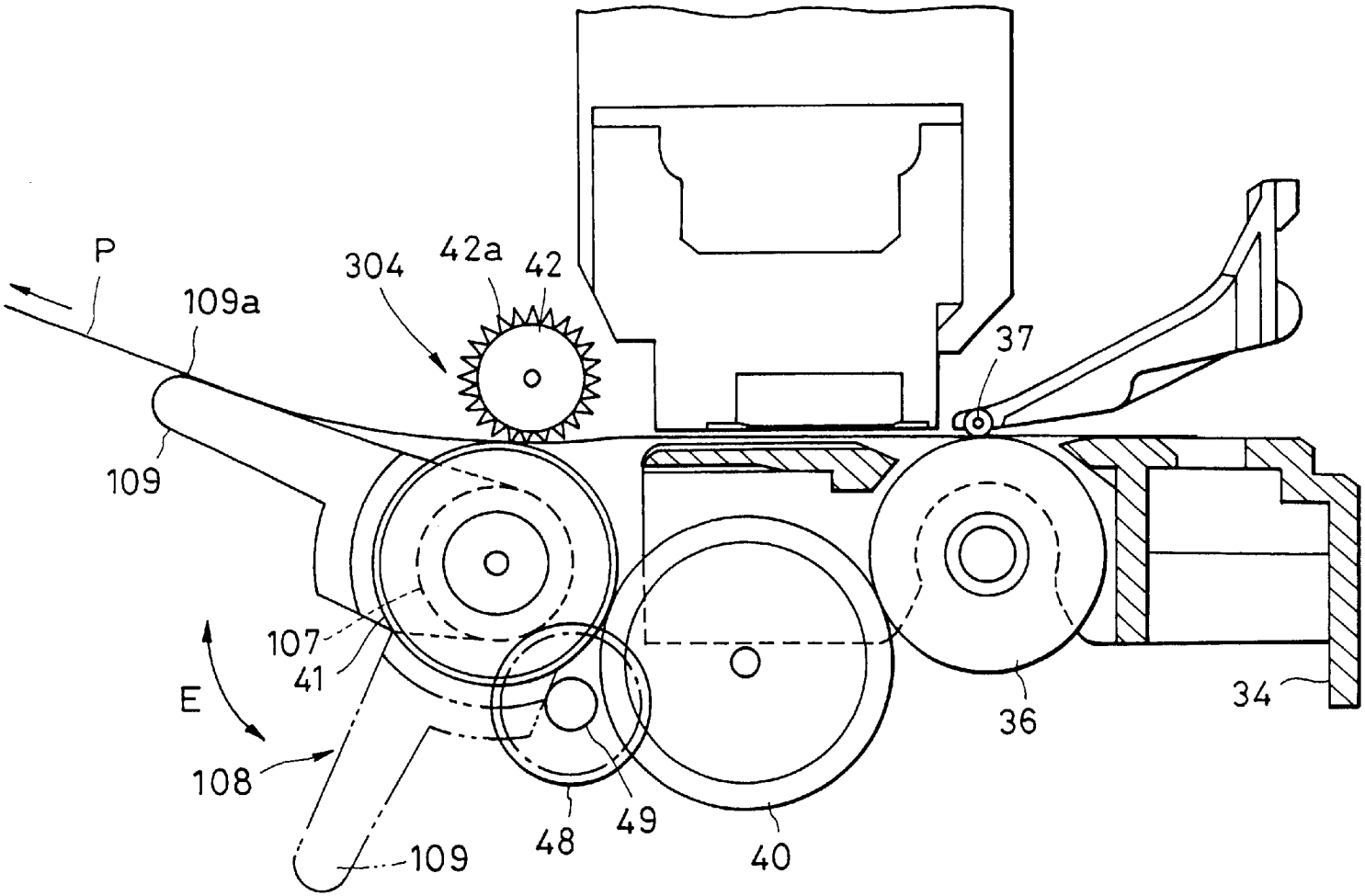
FIG. 7 is a sectional view of an ink jet recording apparatus as a third embodiment of the present invention, taken along a plane which extends in the direction of convey of a recording sheet medium.
Figure 8:
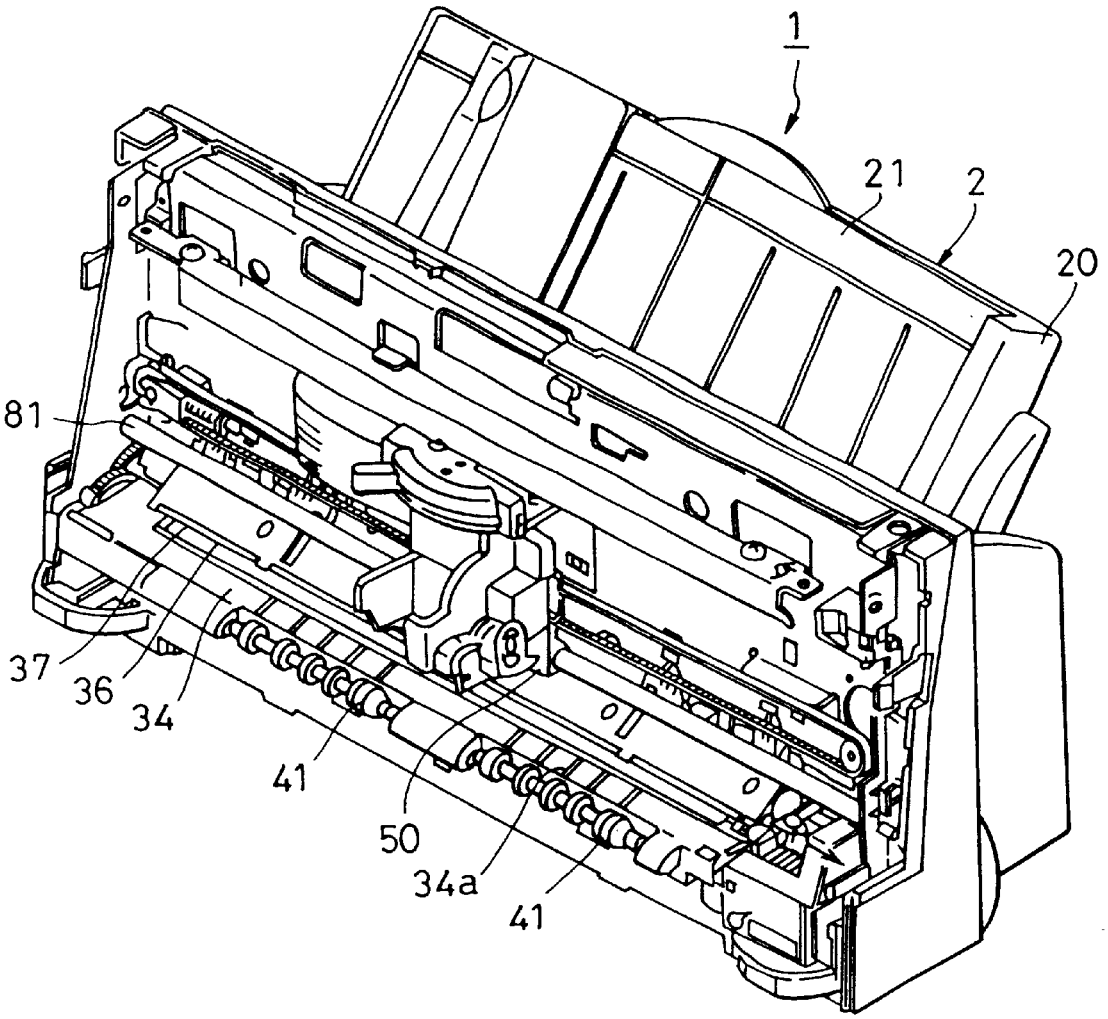
FIG. 8 is a perspective view of a known ink jet recording apparatus.
Figure 9:
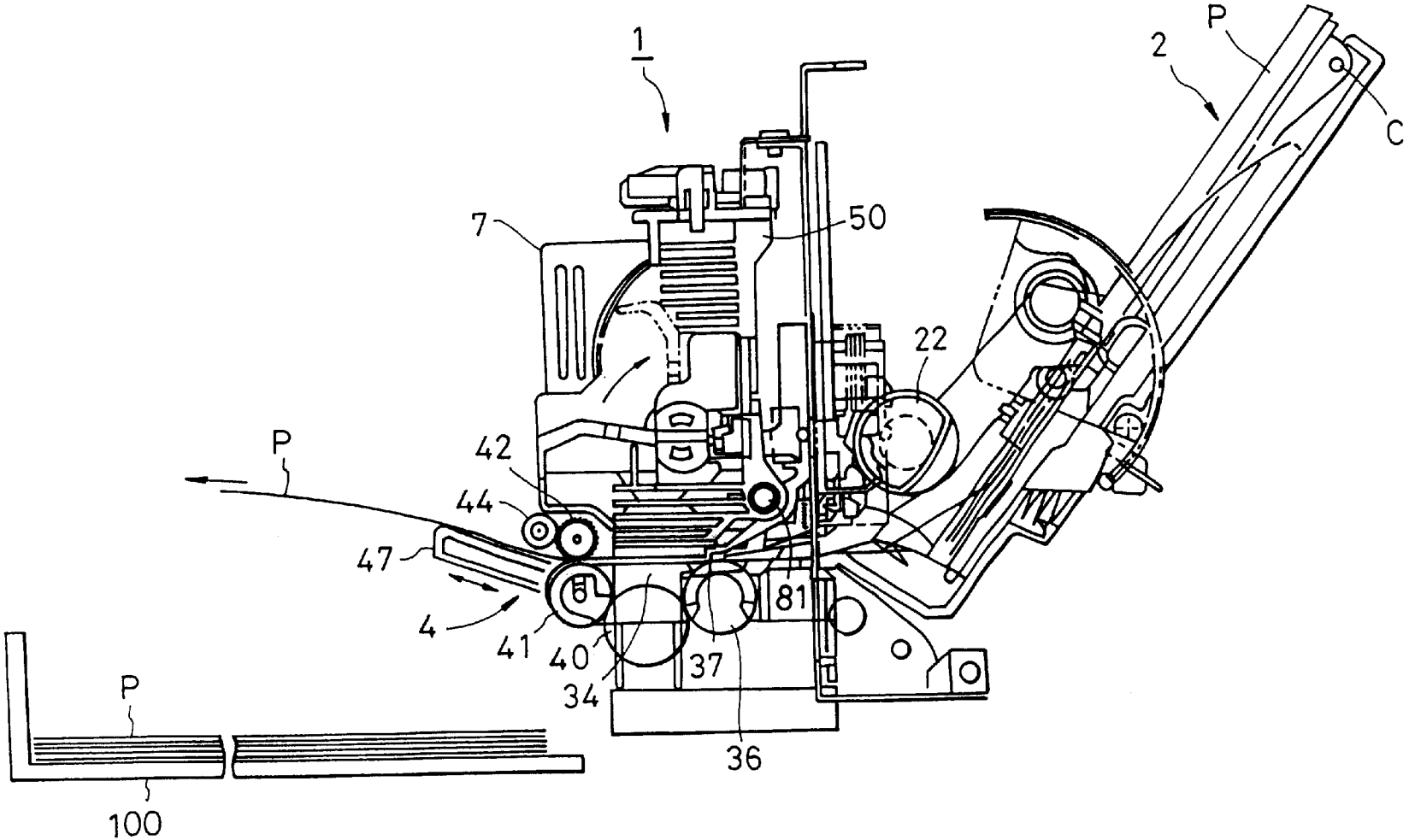
FIG. 9 is a sectional view of the ink jet recording apparatus shown in FIG. 8.
Figure 10:
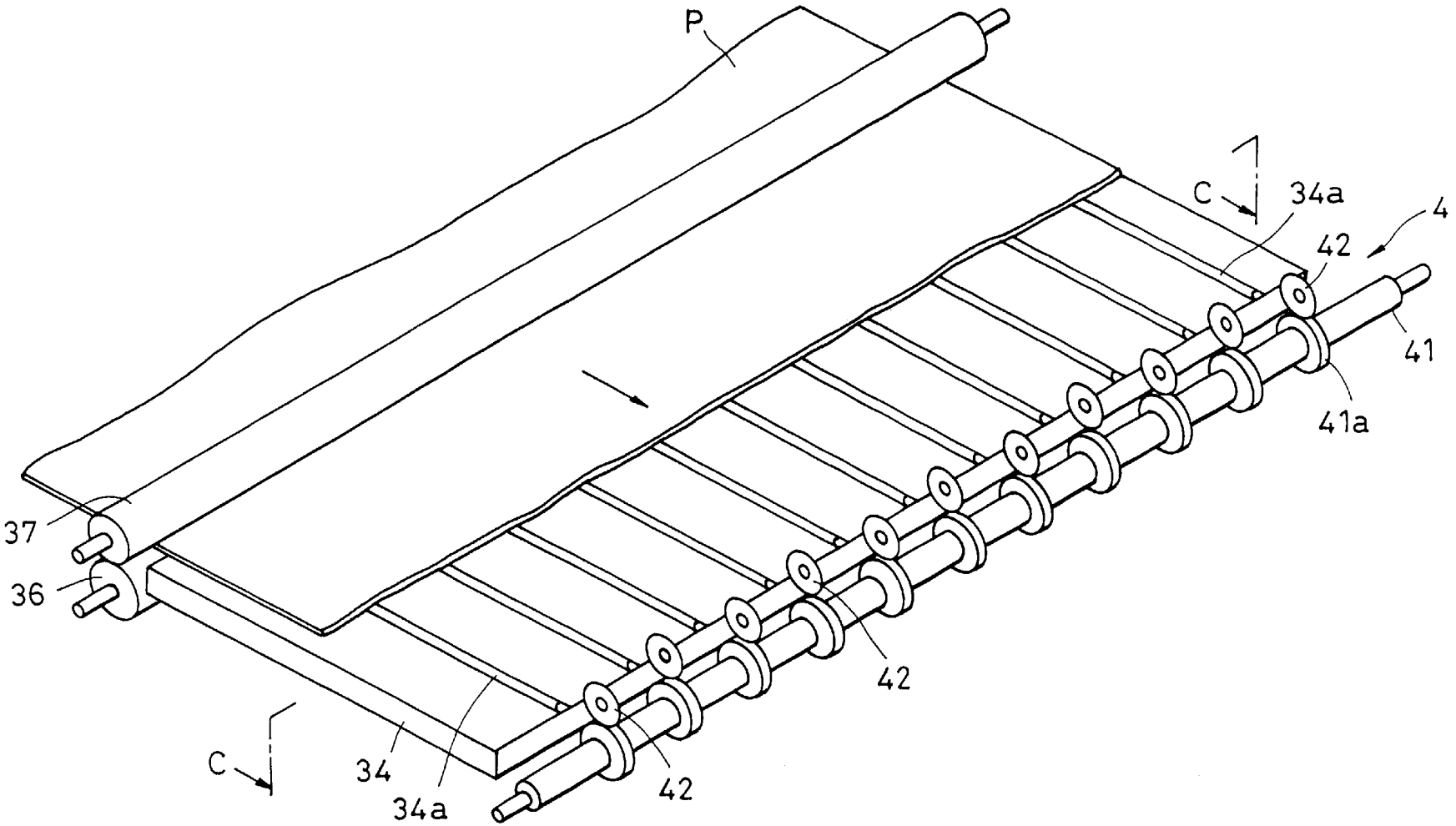
FIG. 10 is a schematic perspective view of a sheet ejection section of the known ink jet recording apparatus.
Figure 11:
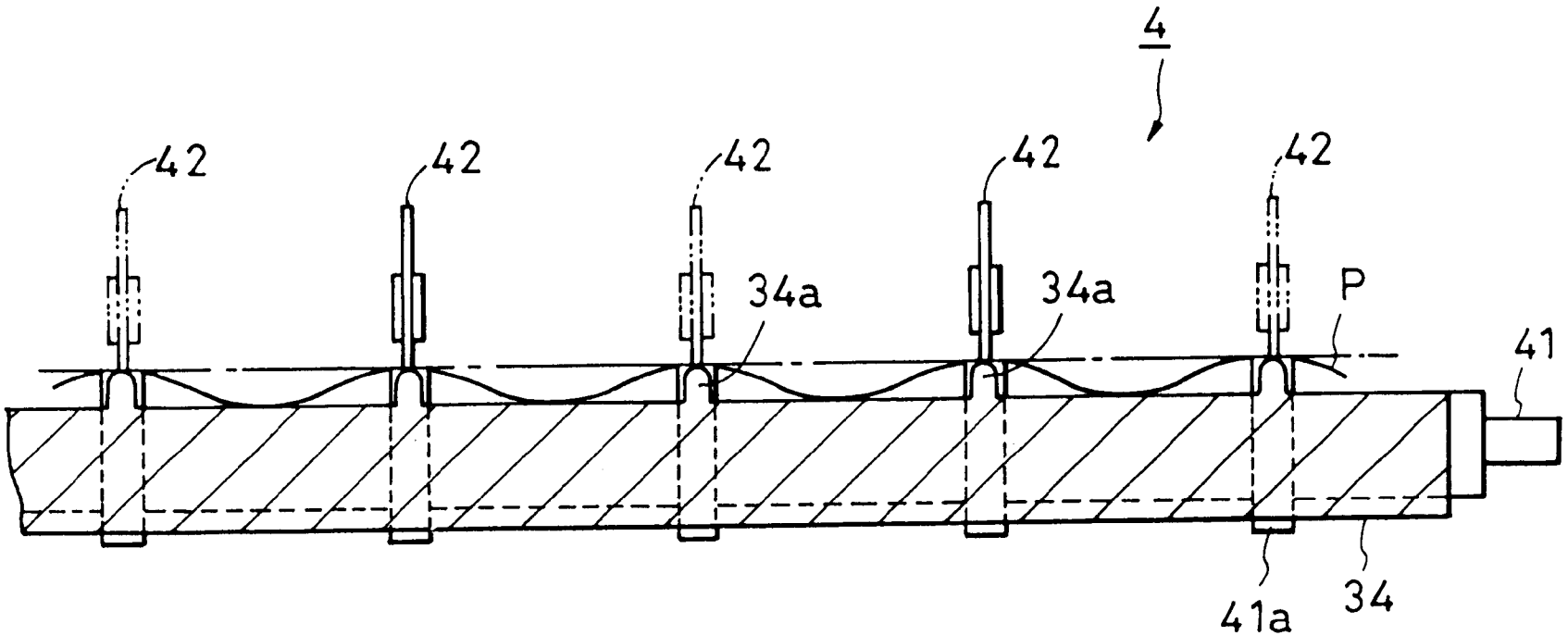
FIG. 11 is a sectional view taken along the line C—C of FIG. 10.

Referring to FIG. 7, an image recording apparatus as a third embodiment of the present invention has a sheet ejection section 304 in which sheet supporting members 109 are rotatable from the retracted position to the supporting position and vice versa about the axis of the ejection roller shaft 41 as indicated by a double-headed arrow "E".

As will be seen from FIG. 7, each of the sheet supporting members 109 is provided with a gear 107 which is centered at the axis of rotation of the sheet supporting member 109 and which is held in engagement with a drive gear 48. In this embodiment, each sheet supporting member 109 is driven by its own associated drive gear 48. The drive gears 48 are carried by a common drive shaft 49 which is driven by a drive motor (not shown). The operation of the drive motor is controlled by a control circuit (not shown), in accordance with the results of the detection performed by the PE sensor 32. The gears 107, the drive gears 48, the drive shaft 49, the drive motor, the control circuit, the PE sensor and other associated components in cooperation provide an operating section or means 108.

In operation, the drive gears are driven by the motor through the drive motor, so that the gears 107 meshing with the drive gears 48 and, hence, the sheet supporting members 109, are rotated as indicated by the arrow "E" so as to be set to the supporting position or the retracted position. Other features of operation are not described because they are substantially the same as that achieved by the sheet ejection section of the first embodiment.

It will be understood that the third embodiment also obviates problems caused by undesirable contact of the recording sheet medium with the recording head 7, such as degradation of the quality of image that is being formed and damaging of the recording head 7. The sheet supporting members 109 also serve to prolong the time until the recording medium sheet after the image formation falls onto the ejection tray, thereby effectively suppressing fouling of the formed image due to smear.

Furthermore, the illustrated embodiment simultaneously achieves both an effect to optimize cockle control performed by an appropriate positioning of the ribs on the platen, sheet ejection rollers and the spurs, and an effect to prevent smearing offered by the sheet supporting members.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus for forming an image on a recording medium by discharging an ink from a recording head, comprising:

at least one ejection roller for causing said recording medium to move at a position downstream of said recording head as viewed in the direction of movement of said recording medium;

at least one idle roller driven by said ejection roller; and at least one recording medium supporting member disposed downstream of said ejection roller as viewed in the direction of movement of said recording medium and arranged to guide said recording medium, said recording medium supporting member and said idle roller being located on a common straight line which extends in the direction of movement of said recording medium.

2. An image forming apparatus according to claim 1, wherein said idle roller comprises a spur which is rotatable in contact with the recording surface of said recording medium.

3. An image forming apparatus according to claim 1, wherein a plurality of said idle rollers are provided, said image forming apparatus further comprising:

a platen for supporting said recording medium at a position where said platen opposes said recording head, said platen having a plurality of ribs formed thereon so as to extend in the direction of movement of said recording medium, said ribs being spaced in the direction of the breadth of said recording medium and are disposed on straight lines which extend in the direction of movement of said recording medium and on which said idle rollers are disposed.

4. An image forming apparatus according to claim 1, wherein said recording medium supporting member is arranged to guide said recording medium to a level above the level at which said recording medium is moved by said ejection roller.

5. An image forming apparatus according to claim 1, wherein said recording medium supporting member is displaceable in the direction of movement of said recording medium.

6. An image forming apparatus according to claim 5, further comprising an operating section for causing the displacement of said recording medium supporting member, such that said recording medium supporting member is displaced in downstream direction as viewed in the direction of movement of said recording medium, before the image is formed on said recording medium by said recording head.

7. An image forming apparatus according to claim 5, wherein said recording medium supporting member is reciprocally movable along a path which is parallel to the direction of movement of said recording medium.

8. An image forming apparatus according to claim 5, wherein said recording medium supporting member is reciprocally rotatable within a plane which is parallel to the direction of movement of said recording medium.

9. An image forming apparatus according to claim 1, wherein a plurality of recording medium supporting members are provided at intervals in the direction of breadth of said recording medium.

10. An image forming apparatus according to claim 9, wherein said plurality of recording medium supporting members are integrally formed to provide a unit.

* * * * *

UNITED STATES PATENT AND TRADEMARK OFFICE

CERTIFICATE OF CORRECTION

PATENT NO. : 6,634,745 B2
DATED : October 21, 2003
INVENTOR(S) : Koichi Tanno

It is certified that error appears in the above-identified patent and that said Letters Patent is hereby corrected as shown below:

Column 12,
Line 39, "downstream" should read -- a downstream --.

Signed and Sealed this

Ninth Day of March, 2004

JON W. DUDAS
*Acting Director of the United States Patent and Trademark Office*